United States Patent [19]

Nordgren

[11] 3,982,652

[45] Sept. 28, 1976

[54] FASTENING DEVICE IN COLLAPSIBLE CONTAINERS

[76] Inventor: Hans-Elov Nordgren, Pl. 4322, S-828 00 Edsbyn, Sweden

[22] Filed: Dec. 21, 1973

[21] Appl. No.: 427,143

[30] Foreign Application Priority Data

Jan. 10, 1973 Sweden ..... 7300279

[52] U.S. Cl. ..... 220/7; 217/16; 217/48

[51] Int. Cl.[2] ..... B65D 7/24

[58] Field of Search ..... 220/6, 7, 1.5, 323; 217/43 A, 16, 48, 12 R, 12 P, 13, 14, 15, 43 R, 44, 45, 46, 47, 48

[56] References Cited

UNITED STATES PATENTS

| | | | |
|---|---|---|---|
| 1,012,277 | 12/1911 | Rapoport | 217/14 |
| 1,123,978 | 1/1915 | Barry | 217/15 |
| 1,650,579 | 11/1927 | McBride | 220/323 |
| 2,525,838 | 10/1950 | Smith | 217/16 |
| 2,833,005 | 5/1958 | Barry | 217/43 A X |
| 3,259,309 | 7/1966 | Johansson | 220/1.5 X |
| 3,830,380 | 8/1974 | Spencer | 220/1.5 X |

FOREIGN PATENTS OR APPLICATIONS

| | | | |
|---|---|---|---|
| 780,720 | 3/1968 | Canada | 220/7 |
| 605,076 | 9/1960 | Canada | 217/15 |
| 1,049,784 | 1/1959 | Germany | 217/43 A |
| 141,067 | 12/1920 | United Kingdom | 217/12 R |

*Primary Examiner*—William Price
*Assistant Examiner*—Stephen Marcus
*Attorney, Agent, or Firm*—Diller, Brown, Ramik & Wight

[57] ABSTRACT

This disclosure relates to a fastening device for use in collapsible containers of the kind comprising on one hand a wall portion including a plurality of walls which are interconnected by means of hinges, on the other at least one sheet portion detachably connected to the wall portion, e.g. a bottom or a lid, at least one locking mechanism being associated with the sheet portion or alternatively the wall portion, the locking mechanism comprising one or a plurality of locking members which are each movable between a locking position inside a recess of the wall portion or alternatively the sheet portion and a releasing position outside the recess, wherein the locking members are arranged to press the sheet portion and wall portion against each other by a wedging action on the introduction of the locking members into the recesses.

19 Claims, 7 Drawing Figures

Figure 1:
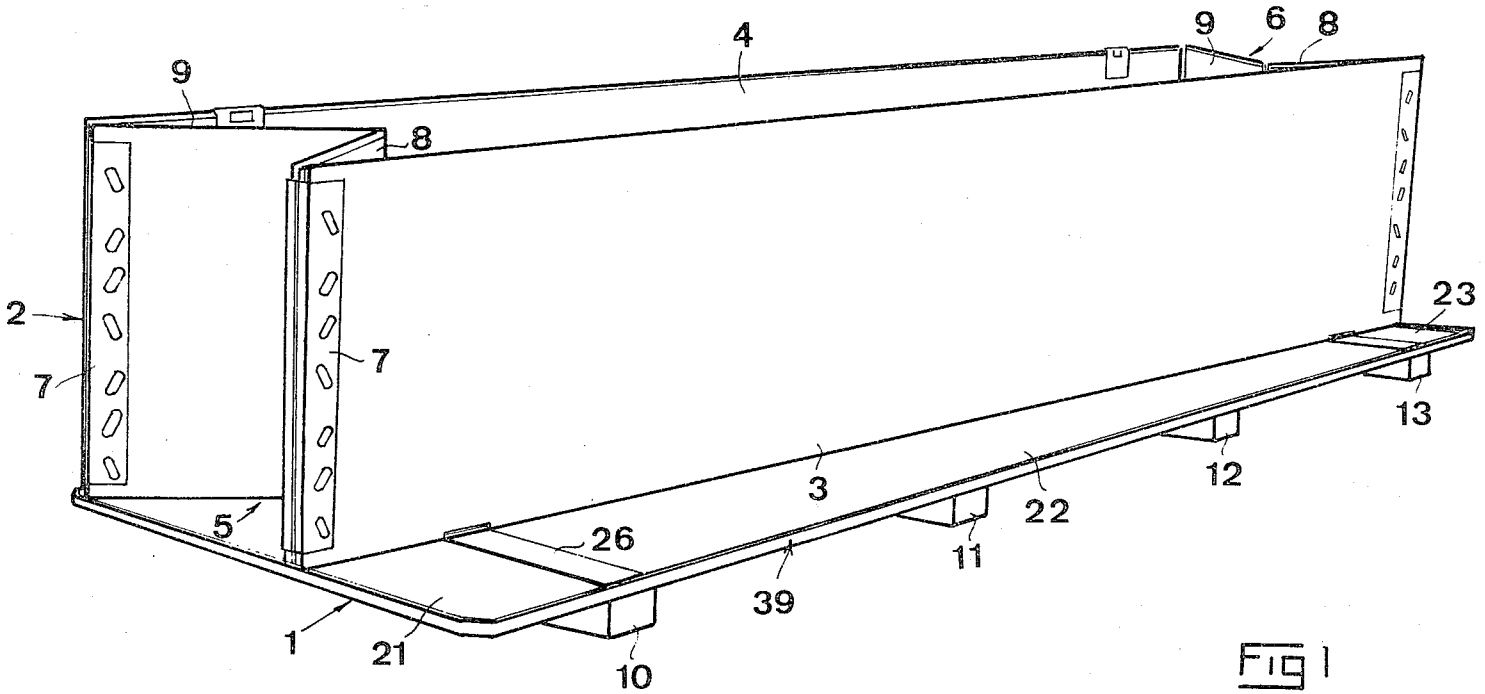

Fig 2
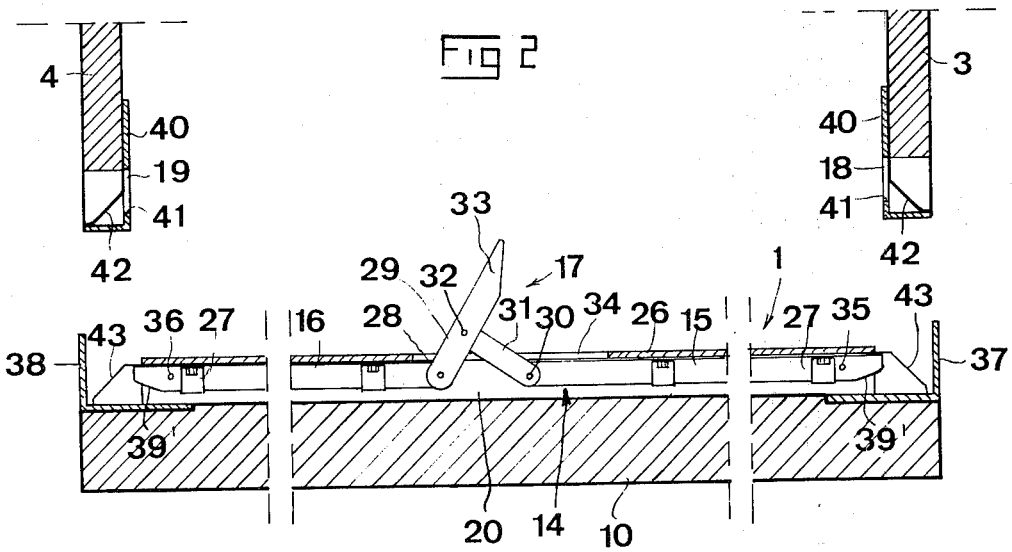
Fig 3
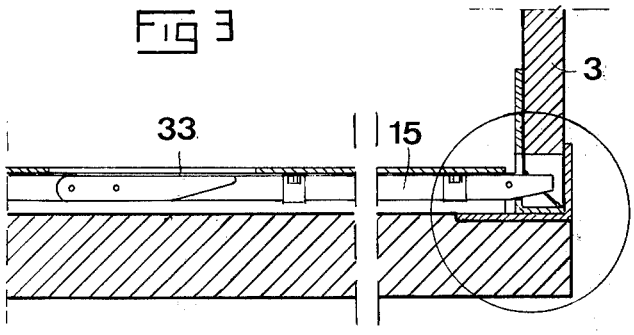
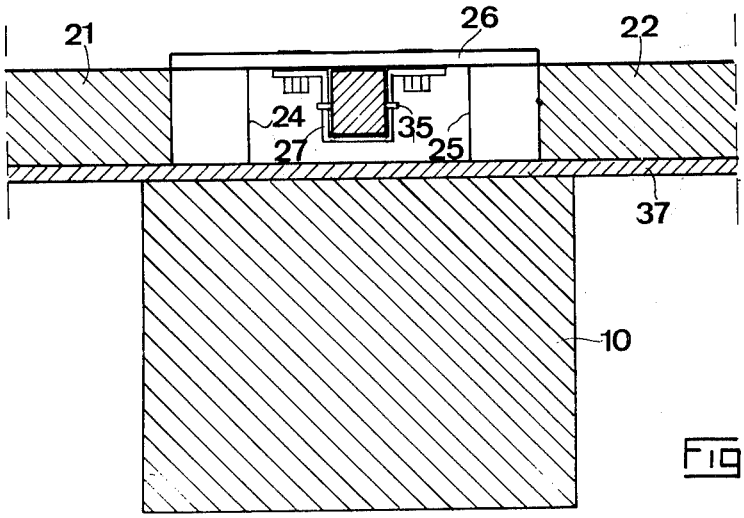
Fig 5

Fig 7
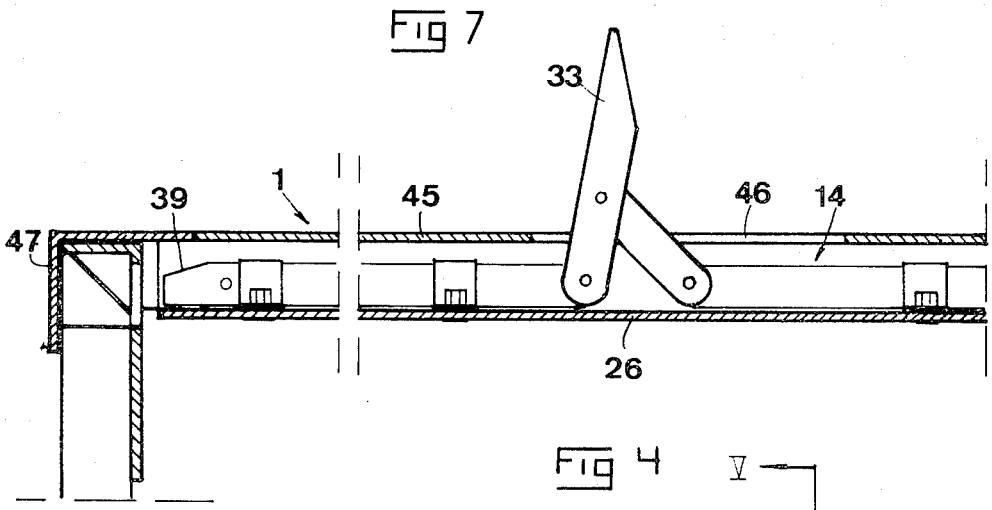
Fig 4
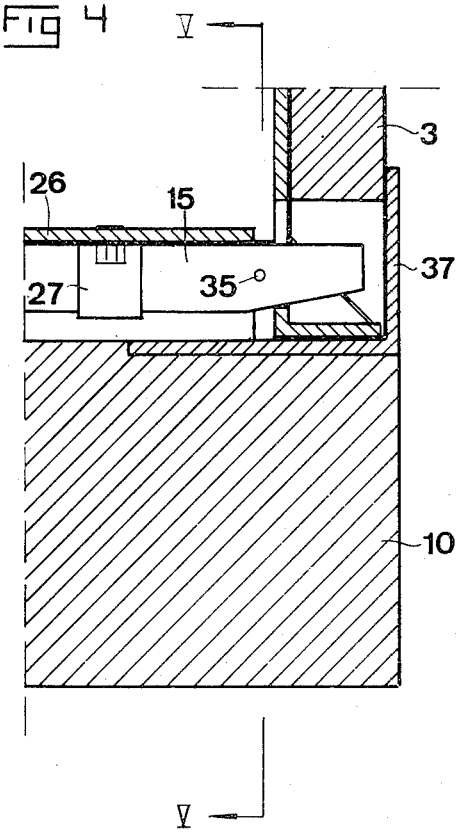
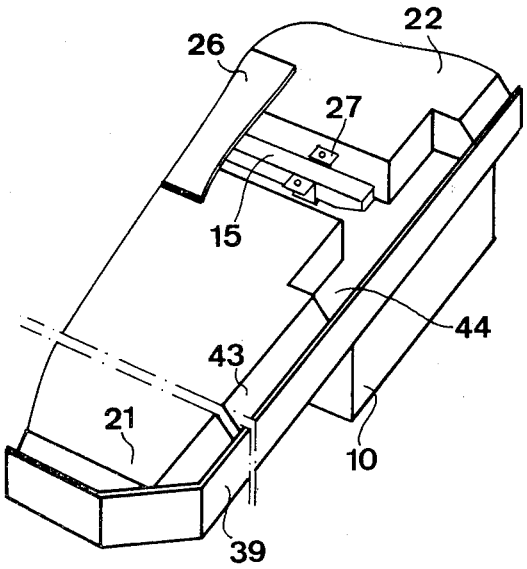
Fig 6

FASTENING DEVICE IN COLLAPSIBLE CONTAINERS

This invention is related to a device for use in collapsible containers of the kind including on one hand a wall portion comprising a plurality of upright panels which are interconnected by means of hinges and on the other at least one sheet portion detachably connected to the wall portion, e.g. a bottom or a lid.

Collapsible containers of the above-mentioned kind are known in the art, in which one or a plurality, preferably two, of opposing walls are in themselves subdivided by a central hinge by means of which the wall in question is foldable or pivotable 180° from a collapsed position in which the wall portions abut to each other into a wholly pivoted position in which the wall portions are coplanar with each other. To secure the wall portion to the sheet portion all of the walls forming the wall portion are at the corners of the container provided with a first type of fixed locking members in the form of holes or recesses while simultaneously the sheet portion is at corresponding locations provided with a second type of fixed locking members in the form of pins insertable into the recesses, the pins coming into engagement with the holes when the walls are pivoted into their wholly pivoted positions. Such fixed pin and hole connections between the wall portion and the sheet portion are satisfactory when relatively small containers are involved or when the requirements of rigidity in the container structure are not too high.

If however the container is to be given greater dimensions difficulties will arise in obtaining a rigid and stable container structure. It has been proved that the walls of the wall portion will be unstable and adopt a tendency of loosening completely or partially from the engagement with the sheet portion; something that may have catastrophic consequences in practice.

By the Swedish patent 22 211 1905 a container is known in the art and of the type including four separate walls which are, together with two sheet portions in the form of a bottom and a lid, capable of being assembled into a container structure by means of two locking mechanisms comprising locking members, which are each movable between a locking position within a recess of the wall in question and a releasing position out of the recess. The positions of the walls relative to the sheet portions are determined by angle irons provided along the perimeter of the sheet portions, said angle irons receiving the edge portions of the walls in such a manner that an edge face at right angles to the plane of the wall is positioned against a bottomlike face of the angle iron likewise at right angles to the plane of the wall. The locking arms are in this connection formed throughout their length with substantially the same cross sectional form and size as the recesses into which they are to engage. This implies that the connection between the walls and the sheet portion in question will be unstable and unreliable, in that the components of the container cannot in practice be manufactured with such a precision that the locking members will fit snugly into exactly localized locking recesses at the same time as the edge faces of the walls are positioned reliably against the bottom surfaces of the angle irons. The result will be a connection having too much play and incapable of providing a desired stiffness and stability to the container structure.

An object of the present invention is to remove the disadvantages related above and ensure an absolutely safe and rigid cohesion between the wall portion and sheet portion or sheet portions.

What primarily characterizes the invention is the fact that the locking members are arranged to press the sheet portion and wall portion against each other by a wedge action when entering into the recesses.

With reference to the appended drawings below follows a more specific description of a number of embodiments of the invention, cited as examples.

In the drawings:

FIG. 1 is a perspective view of a collapsible container comprising a wall portion as well as a sheet portion in the form of a bottom, FIG. 2 is a cross sectional view through the container structure shown in FIG. 1 with the wall portion released and raised from the sheet portion or bottom, certain portions of the sheet and wall portions respectively being broken away, FIG. 3 is a cross sectional view similar to that in FIG. 2 but showing the wall portion in engagement with the sheet portion and the left hand half of the container structure being omitted, FIG. 4 is an enlargement of the assembly encircled in FIG. 3, FIG. 5 is a longitudinal cross sectional view taken along the line V - V in FIG. 4, FIG. 6 is a perspective view of a portion of the sheet or bottom portion of the container, and FIG. 7 is a fragmentary cross sectional view through a connection between the wall portion and a sheet portion in the form of a lid.

The container shown in FIG. 1 includes a sheet unit 1 forming the bottom thereof and a wall forming portion a wall assembly designated by the numeral 2 and comprised of two longitudinal side walls 3 and 4 and two flank side walls 5 and 6.

The longitudinal side walls and the flank side walls are interconnected by means of hinges 7 in the form of hinge-like strips. The two flank side walls 5 and 6 are in turn subdivided into two portions 8 and 9 and hingedly connected together by hinges not visible in the drawing. The walls as well as the sheet portion are preferably formed of material capable of being nailed as for instance plywood panels.

The bottom wall 1, side walls 3 and 4, and flank side wall portions 8 and 9, being formed of sheet material, all have opposite face surfaces bordered by edge surfaces, as would normally be expected.

On the lower side of the sheet portion or bottom 1 cross bars 10, 11, 12, and 13 are provided, for instance in the form of wood beams, the purpose of which is among other things to maintain the bottom 1 at a certain level above a support onto which the container is deposited so as to make it possible to raise the container, for instance, by means of a fork truck.

Now reference is made to FIGS. 2 - 6 wherein there is shown more specifically the device according to the invention. With the sheet portion 1 at least one locking mechanism, generally designated by the numeral 14, is associated and which locking mechanism or latch means includes two locking members 15 and 16 which are each movable by means of a control means between a locking position inside the openings 18 and 19 of the walls 3 and 4 and a releasing position outside the recesses. In illustrated embodiment the two locking members 15 and 16 are in the form of arms which are accomodated inside an elongate, slot like space 20 which is substantially disposed between the upper side and lower side of the sheet portion 1.

The sheet portion 1 is in the illustrated embodiment (see FIG. 1) is assembled of three pieces of sheet 21, 22, and 23, the vertical edge faces 24 and 25 between, for instance the sheet pieces 21 and 22, (see FIG. 5) are spaced from each other to define a slot like space 20. It is to be observed that the slot 20 overlies the cross bar 10. In addition to the cross bar 10 and the two vertical edge faces 24 and 25 of the sheet pieces 21 and 22, the space 20 is defined by a support plate or piece of sheet metal 26 having edge portions resisting on the. This support plate carries on its lower side a number of substantially U-shaped brackets or yokes 27 the purpose of which is to retain and guide the arms 15 and 16 of the locking mechanism. This is however not the only object of the support plate 26, since it also holds the two sheet pieces 21 and 22 together with the cross bar 10 in that fastening members for instance in the form of nails (not shown) are driven or passed through the plate 26 and the edge portions of the sheet pieces 21 and 22 into the cross bar 10.

As best appears in FIG. 2 the locking arm 16 is through a first hinge pin 28 connected to a first link 29 and the locking arm 15 is through a second hinge pin 30 connected to a second link 31. The two links 29 and 31 are, in turn, connected through a third hinge pin 32. The distance between the first hinge pin 28 and the third hinge pin 32 is somewhat less than the distance between the second hinge pin 30 and the third hinge 32. The first link 29 is extended by a portion 33 which functions as a control lever. In the support plate 26 there is a slot 34 through which the control lever 33 can be pivoted upwards from the substantially horizontal locking position shown in FIG. 3 into the upwardly pivoted releasing position shown in FIG. 2. It will be obvious that when the control lever 33 is pivoted upwardly in a counterclockwise direction, the arms 15 and 16 are moved towards each other, while pivoting of the control lever in a clockwise direction requires that the arms are moved away from each other.

Each of the arms 15 and 16 has a stop 35 and 36, respectively, provided to cooperate with fixed shoulders, in this case in the form of the outermost brackets 27 on the lower side of the support plate 26 to limit the movement of the arms towards each other. As shown in FIG. 2, the sheet portion 1 is provided, at least at its longitudinal side edges, with edge mountings 37 and 38, the object of which is to accomodate the wall portion 2 therebetween. More specifically, the two edge mountings 37 and 38 form portions of a collar-like edge mounting which is generally designated by the numeral 39 and extends all around the perimeter of the sheet portion 1. The edge mountings 37 and 38 have opposed inner surfaces defining stop surfaces.

The distance between the ends of the arms 15 and 16 facing away from each other in a condition when the arms are moved into a maximum distance from each other should be substantially equal to or somewhat less than the distance between the two opposite edge mountings 37 and 38. This assures that the arms 15 and 16 will properly engage in the openings 18 and 19, respectively of the walls 3 and 4.

According to the invention each of the locking arms 15 and 16 has at its outer ends on the lower side a surface 39' which is inclined relative to the longitudinal extension of the arm.

The recesses 18 and 19 are formed in special L-shaped mountings 40 secured at the lower edges of the walls 3 and 4 and defining projections. The openings 18 and 19 are defined below by a portion 41 forming a seat against which the inclined surface 39' of the associated locking arm is abuttable.

According to the invention all of the walls forming the wall portion 2 are chamfered at their lower edges to form inclined surfaces 42 at the bottom of the walls. To these chamfered surfaces 42 correspond analogous chambers 43 along the edges of the sheet portion 1.

As shown in FIG. 6 the chamfered edges 43 (as well as the chamfers 42) are interrupted by recesses 44, the length of which may be approximately equal to the width of the cross bar 10.

The locking mechanism described above operates in the following manner. In a starting position, when a wall portion 2 is to be interlocked with the sheet portion 1, the control lever 33 of the control means 17 is pivoted upwardly to the position shown in FIG. 1 wherein the two locking arms 15 and 16 are retracted as far as possible towards one another, and then the walls 3 and 4 positioned on the sheet portion with their chamfered edge surfaces 42 resting against the similarly chamfered edge surfaces 43 of the sheet portion 1. After the wall 2 is seated onto the sheet portion 1 the control lever 33 is pivoted by means of a simple manual operation in a clockwise direction, and the arms 15 and 16 are moved in a direction outwards of the center of the container. During this sliding movement the two inclined surfaces 39' of the locking arms 15 and 16 will contact the seats of the portions 41 beneath the openings 18 and 19, and the walls 3 and 4 will be pressed downwardly and firmly wedged against the sheet portion, by the arms due to the wedging action provided by the engagement of the inclined surfaces 39' against the portions 41 and by the fact that the lower chamfered surfaces 42 of the walls abut against the analogous chamfers 43 of the sheet portion 1. It will be apparent that the coaction of the chamfers 42 and 43 cause the walls 3 and 4 to forcibly abut this respective edge mounting 37 and 38 to fixedly position the walls, as is clearly shown in FIG. 4.

In FIG. 7 an embodiment is shown wherein the sheet portion 1 is in the form of a lid. In this embodiment the locking mechanism 14 is disposed on the top side of the support plate 26, the mechanism being covered by a separate cover plate 45 having a recess 46 for the control lever 33. Similar to the bottom the lid 1 has an edge mounting 47 preferably shaped as a collar. It is to be observed that the oblique or wedge surface 39' of the locking arms is sloping upwards to effect a depressing of the lid 1 against the wall portion 2.

As indicated in FIG. 1, associated with each sheet portion 1 is not only one but two or more of locking mechanisms of the kind described.

As further appears in FIG. 1 the described collapsible container may have a length which is considerably greater than its width. Thus, the length of the container may amount to 3 – 10 times its width.

The advantages of the invention are obvious in that the collapsible container will be extremely stable and resistant through simple and little expensive means.

The invention is not limited to the embodiments described and shown in the drawings. It is for instance possible to apply the invention in connection with collapsible containers having another shape than the rectangular or square one shown. The flank walls of the container are not necessarily subdivided in the manner shown but may be made integral. Neither the sheet portion 1 nor the walls of the wall portion 2 need have chamfered edges of the kind exemplified but may be shaped in another manner, wherein the wedging action for secure gripping of the wall portion to the sheet portion is obtained solely by the locking members themselves. It is further possible to provide the locking mechanism in connection with the wall portion instead of in connection with a sheet portion as exemplified above, in which case the arms of the mechanism are moved into a locking engagement with recesses provided in the sheet portion instead of in the wall portion. Also other modifications of the invention are conceivable within the scope of the patent claims.

What is claimed is:

1. A collapsible container comprising a plurality of interconnected walls defining an enclosure, said walls including two spaced opposing walls having at least one end edge facing in generally the same direction, a third wall having a face opposing said two walls end edges, and a locking mechanism releasably connecting said third wall to said two walls, said locking mechanism including a pair of oppositely facing locking members carried by said third wall, openings in said two walls for receiving said locking members and cooperating with said locking members for urging said end edges against said third wall, and a common actuator for said locking members.

2. A device according to claim 1, wherein each of said locking members has a stop provided to cooperate with fixed shoulders of the third wall to limit the movements of the locking members towards each other.

3. The container of claim 1 wherein said third wall has a thickness and said locking members and said actuator being positioned within said third wall.

4. The container of claim 3 wherein said actuator includes first and second links pivotally connected to said arms by first and second hinge means and to one another remote from said arms by third hinge means, and one of said links having an extension in the form of a lever.

5. The container of claim 1 wherein said two walls engage said third wall adjacent remote edges of said third wall, and there are edge mountings of said third wall along said third wall remote edges engaging said two walls and limiting separation thereof.

6. The container of claim 5 wherein said two wall end edges and surfaces of said third wall engaged thereby are sloping surfaces with said end edge surfaces facing away from respective ones of said edge mountings and said third wall surfaces facing towards respective ones of said edge mountings, said sloping surfaces cooperating to force said two walls apart and against said edge mounting in response to the actuation of said locking mechanism.

7. A device according to claim 5, wherein the distance between said first and said third hinge means is less than the distance between said second and said third hinge means.

8. A device according to claim 5, wherein the distance between the ends of the locking members remote from each other, in a condition when the locking members are moved apart, is no greater than the distance between said two edge mountings of said third wall.

9. In a collapsible container, two walls disposed in angular relation, said walls having face surfaces and edge surfaces and one of said walls having an edge surface thereof generally opposing the face surface of the other of said walls, said other wall having an recess formed in the face surface thereof in alignment with said one wall, a separately formed projection on said one wall extending from that edge surface of said one wall opposing said other wall and extending into said recess, and latch means carried by said other wall and engaging said projection in a manner forcibly urging said projection into said recess and drawing said one wall edge surface into forcible engagement with said other wall to maintain said angular relation.

10. The container of claim 9 wherein said other wall has a stop surface thereon engaging a face surface of said one wall, said other wall face surface portion and said one wall edge surface being inclined relative to the general plane of said other wall with said one wall edge surface facing away from said stop surface and said other wall face surface portion facing towards said stop surface wherein forcible seating of said one wall edge surface on said other wall face surface portion by said latch means urges said one wall to a predetermined position against said stop surface.

11. The container of claim 9 wherein said latch means includes a locking member carried by said other wall in the general plane thereof and projectable into said recess, said projection defines an opening for receiving said locking member, and said projection and said locking member having opposing surfaces disposed generally parallel to the plane of said other wall.

12. The container of claim 11 wherein said opposing surfaces include a surface sloping relative to the plane of said other wall and in a direction to draw said projection into said opening when said locking member is moved into said opening.

13. A collapsible container comprising a wall assembly, a sheet member, and latch means detachably connecting together said wall assembly and said sheet member, said wall assembly including a plurality of interconnected walls, said sheet member having at least one edge portion cooperatively engaging an edge portion of one of said walls, cooperating ones of said edge portions including an inclined surface and said inclined surfaces of said sheet member and said one wall abutting one another, said latch means including a locking mechanism locking together said sheet member and said one wall, said locking mechanism including a locking member and a cooperating opening carried by said sheet member and said one wall, and means mounting said locking member for movement between a released position outside of said opening and a wedging locking position projecting into said opening forcibly urging said inclined surfaces together.

14. A container according to claim 13 characterized in that the portion of said locking member which is insertable into said opening has a surface inclined relative to the direction of movement of said locking member and abuttable against a seat of said recess, which locking member surface ensures said wedging action of said locking member.

15. A container according to claim 13, characterized in that in the area of said locking member and said opening, that one of said inclined surfaces associated with said locking member is interrupted by a recess, and said opening is formed in a member projecting from the other of said inclined surfaces into said recess.

16. A container according to claim 13, characterized in that there are two of said locking members and two of said openings, said locking members being carried by said sheet member and said openings by two opposed ones of said walls including said one wall, and said locking members are arranged in alignments and interconnected through first and second hinges connected to links which are in turn interconnected through a third hinge spaced from said first and second hinges, and that link provided with said first hinge is extended to form a control lever, the locking members being movable towards and away from each other by pivoting the control lever about said first hinge.

17. A container according to claim 16, characterized in that the distance between said first and said third hinges is less than the distance between said second and said third hinges.

18. A container according to claim 16, characterized in that each of said locking members has a stop arranged to cooperate with a fixed shoulder on the sheet member to limit the movements of said members towards each other.

19. A container according to claim 16, characterized in that said sheet member has two remote and opposed edge mountings, and the distance between the ends of said locking members remote from each other in a condition when said locking members are moved apart is substantially equal to the distance between said two edge mountings.

* * * * *